US010526844B2

(12) United States Patent
Lantz

(10) Patent No.: US 10,526,844 B2
(45) Date of Patent: Jan. 7, 2020

(54) TOP DRIVE FOR A DRILLING RIG

(71) Applicant: MHWIRTH AS, Kristiansand S (NO)

(72) Inventor: Stian Lantz, Kristiansand S (NO)

(73) Assignee: MHWIRTH AS, Kristiansand S (NO)

( * ) Notice: Subject to any disclaimer, the term of this patent is extended or adjusted under 35 U.S.C. 154(b) by 253 days.

(21) Appl. No.: 15/444,339

(22) Filed: Feb. 28, 2017

(65) Prior Publication Data

US 2017/0254147 A1 Sep. 7, 2017

(30) Foreign Application Priority Data

Mar. 2, 2016 (NO) ..... 20160357
Mar. 2, 2016 (NO) ..... 20160361

(51) Int. Cl.
*E21B 3/02* (2006.01)
*E21B 19/06* (2006.01)
*E21B 19/16* (2006.01)

(52) U.S. Cl.
CPC ..... *E21B 3/02* (2013.01); *E21B 19/06* (2013.01); *E21B 19/161* (2013.01)

(58) Field of Classification Search
CPC ..... E21B 19/06; E21B 19/161; E21B 3/02
See application file for complete search history.

(56) References Cited

U.S. PATENT DOCUMENTS

| | | | | |
|---|---|---|---|---|
| 3,768,579 | A | 10/1973 | Klein | |
| 4,667,752 | A | 5/1987 | Berry et al. | |
| 4,753,300 | A | 6/1988 | Shaw et al. | |
| 4,878,546 | A | 11/1989 | Shaw et al. | |
| 5,388,651 | A | 2/1995 | Berry | |
| 5,433,279 | A | 7/1995 | Tessari et al. | |
| 5,544,712 | A | 8/1996 | McEwen et al. | |
| 5,664,606 | A | 9/1997 | Anderson | |
| 6,276,450 | B1 | 8/2001 | Seneviratne | |
| 7,055,594 | B1 | 6/2006 | Springett et al. | |
| 2005/0173154 | A1 | 8/2005 | Lesko | |
| 2005/0269104 | A1 | 12/2005 | Folk et al. | |
| 2006/0113084 | A1 | 6/2006 | Springett et al. | |
| 2006/0113087 | A1 | 6/2006 | Springett et al. | |
| 2007/0074874 | A1 | 4/2007 | Richardson | |
| 2008/0099221 | A1 | 5/2008 | Lynch | |
| 2008/0135228 | A1* | 6/2008 | Wells | E21B 19/16 166/77.51 |
| 2008/0238095 | A1* | 10/2008 | Yater | E21B 21/02 285/333 |
| 2017/0067303 | A1* | 3/2017 | Thiemann | E21B 3/02 |

* cited by examiner

*Primary Examiner* — Caroline N Butcher
(74) *Attorney, Agent, or Firm* — Norman B. Thot

(57) ABSTRACT

A top drive for a drilling rig includes a top drive housing, a threaded element used in a drilling operation, the threaded element having a grooved surface, and a back-up wrench with a toothed surface which engages with the grooved surface of the threaded element. The back-up wrench is suspended from the top drive housing. The back-up wrench is movable in relation to the top drive housing so as to selectively engage the threaded element.

15 Claims, 5 Drawing Sheets

TOP DRIVE FOR A DRILLING RIG

CROSS REFERENCE TO PRIOR APPLICATIONS

Priority is claimed to Norwegian Patent Application No. NO 20160357, filed Mar. 2, 2016, and to Norwegian Patent Application No. NO 20160361, filed Mar. 2, 2016. The entire disclosure of said applications is incorporated by reference herein.

FIELD

The present invention relates to a top drive for a drilling rig.

BACKGROUND

Top drives are commonly used in the oil and gas industry for rotating drill pipe during drilling operations. The top drive is generally arranged in a drilling rig, and is raised and lowered using a hoisting system, such as a drawworks arrangement. The top drive comprises motors, for example, electric or hydraulic motors, to provide rotational torque on the drill string.

Top drives are subject to high operational demands. The top drive is usually subjected to very high forces in use due to the high torques required during drilling and the large weight of the drill string. The top drive will also experience large load variations during the repeated connect/disconnect sequences when adding or removing sections of pipe to the drill string, and it may also be subject to very high adverse loads such as vibrations or other forces extending upwards through the drill string, for example, during jarring events. Top drives therefore require periodic inspection and maintenance.

Related prior art which is useful for understanding the design and use of conventional top drive systems includes: US 2008/135228 A1; US 2006/113084 A1; U.S. Pat. No. 5,388,651 A; EP 0747567 A2; EP 0712992 A2; US 2007/074874 A1; US 2008/099221 A1; US 2008/238095 A1; US 2006/113087 A1; U.S. Pat. Nos. 3,768,579 A; 4,667,752 A; 7,055,594 B1; 5,433,279 A; 6,276,450 B1; US 2005/269104 A1; US 2005/173154 A1; U.S. Pat. Nos. 4,753,300 A; and 4,878,546 A.

A continuous need exists for improved systems and methods in relation to top drive operation and maintenance, in particular in light of the tendency of the industry to move into harsher and more challenging areas, for example, deep-water resources or arctic areas. This includes solutions for improving reliability and for simplifying maintenance of the top drive and its various components.

SUMMARY

An aspect of the present invention is to provide an improved method and system for operating and/or carrying out maintenance and repairs on top drives which obviate or reduce disadvantages associated with known systems and techniques.

In an embodiment, the present invention provides a top drive for a drilling rig which includes a top drive housing, a threaded element used in a drilling operation, the threaded element comprising a grooved surface, and a back-up wrench comprising a toothed surface which is configured to engage with the grooved surface of the threaded element. The back-up wrench is suspended from the top drive housing. The back-up wrench is configured to be movable in relation to the top drive housing so as to selectively engage the threaded element.

BRIEF DESCRIPTION OF THE DRAWINGS

The present invention is described in greater detail below on the basis of embodiments and of the drawings in which.

DETAILED DESCRIPTION

Figure 1:
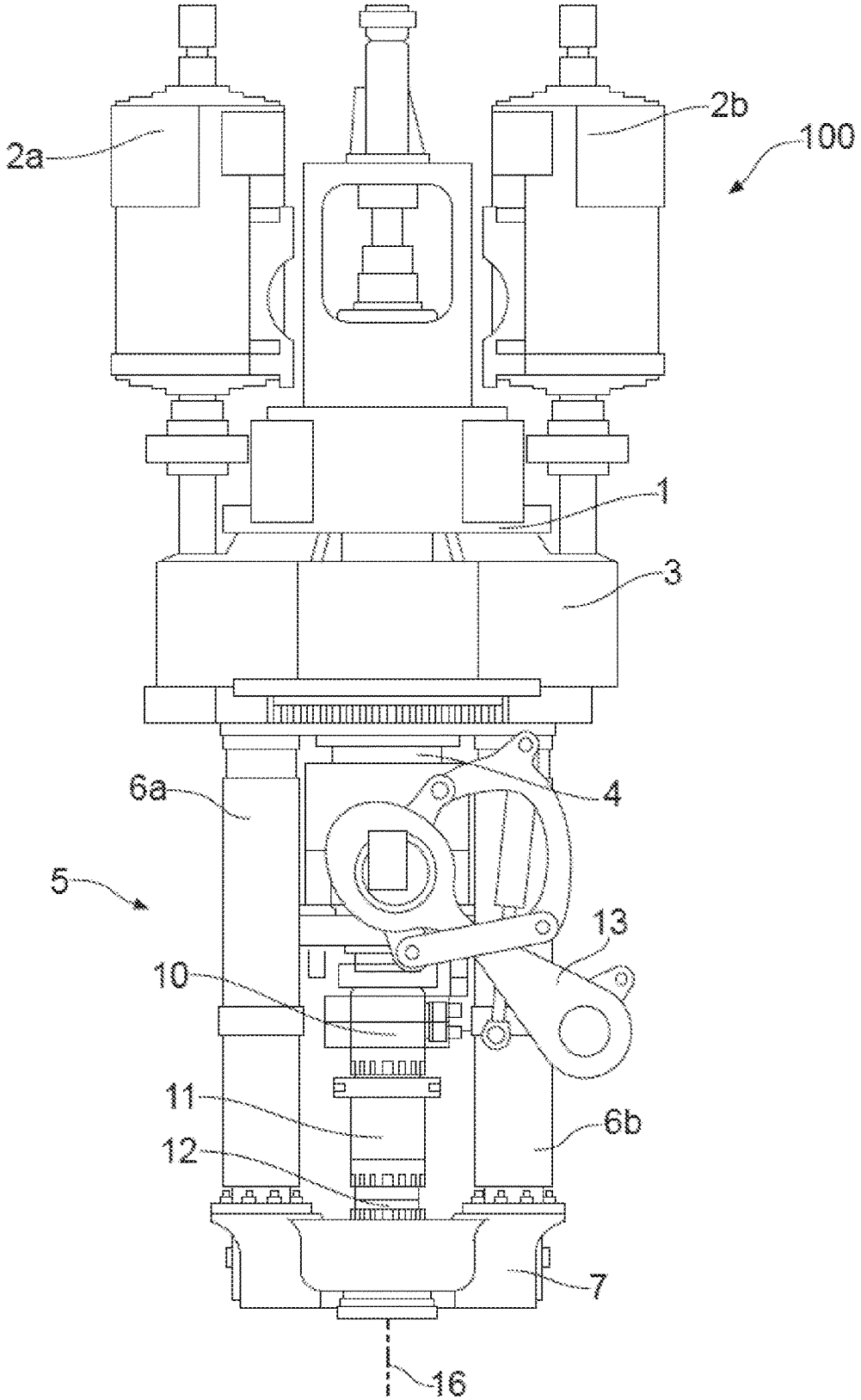
FIG. 1 illustrates a top drive.

In an embodiment of the present invention, the threaded element can, for example, be a saver sub, a kelly valve, and an inside blow out preventer.

In an embodiment of the present invention, the threaded element can, for example, be suspended from a main drive shaft of the top drive.

It could be advantageous, for example, if the grooved surface is arranged in a lower part of the threaded element.

In an embodiment of the present invention, the toothed surface can, for example, be provided on at least one plate within the back-up wrench, the plate being movable along an axis different from the central longitudinal axis of the top drive.

In an embodiment of the present invention, the toothed surface can, for example, be provided on two plates, the plates being individually movable along the axis different from the central longitudinal axis of the top drive.

It can be advantageous, for example, if the toothed surface comprises a plurality of teeth projecting inwardly in relation to the longitudinal axis of the top drive.

In an embodiment of the present invention, a top drive for a drilling rig can, for example, be provided, the top drive comprising a central longitudinal axis, a top drive housing, a first suspension element, a second suspension element, and a back-up wrench, the back-up wrench being suspended from the top drive housing via the first suspension element and the second suspension element, wherein the first suspension element is selectively connectable to the back-up wrench, the top drive further comprising a pivotable coupling adapted to allow pivoting of the entire back-up wrench in a plane substantially perpendicular to the central longitudinal axis when the back-up wrench is disconnected from the first suspension element.

It can be advantageous if the pivotable coupling is, for example, provided in the second suspension element.

It can also be advantageous if the pivotable coupling is, for example, provided in a connection point between the second suspension element and the back-up wrench.

In an embodiment of the present invention, the first suspension element and/or the second suspension element can, for example, be telescopic cylinders.

In an embodiment of the present invention, the back-up wrench can, for example, be pivotable around an axis parallel to the longitudinal axis of the top drive.

In an embodiment of the present invention, the back-up wrench can, for example, be pivotable around a central axis of the second suspension element.

In an embodiment of the present invention, the top drive can, for example, further comprise a stack having at least one inside blow out preventer, wherein the top drive has (i) a first operational configuration in which the stack is carried by a main drive shaft of the top drive, and (ii) a second operational configuration in which the stack is carried by the back-up wrench. It can be advantageous if, for example, in the second operational configuration, the stack is spaced from a central longitudinal axis of the top drive.

Exemplary embodiments of the present invention will now be described with reference to the drawings. The basic design and functionality of conventional top drive systems have previously been described and will therefore not be described in detail herein. Reference is made to the above mentioned patent publications.

FIG. 1 shows a top drive 100, having a housing 1, drilling motors 2*a* and 2*b*, and a gear box 3. The drilling motors 2*a* and 2*b* drive a main drive shaft 4 via the gear box 3. A telescopic torque arrestor frame 5 is connected to the housing 1 and comprises a first cylinder 6*a*, a second cylinder 6*b*, and a back-up wrench (BUW) 7. The BUW 7 can be moved vertically in relation to the frame 1 via the first and second cylinder 6*a*/6*b*. FIG. 1 further shows an upper inside-blow-out-preventer (IBOP) 10, a lower IBOP 11, and a saver sub 12, all threadedly connected and fixed to the drive shaft 4 of the top drive 100. Elevator links 13 are provided to handle sections of drill pipe via an elevator (not shown in the drawings).

Figure 2:
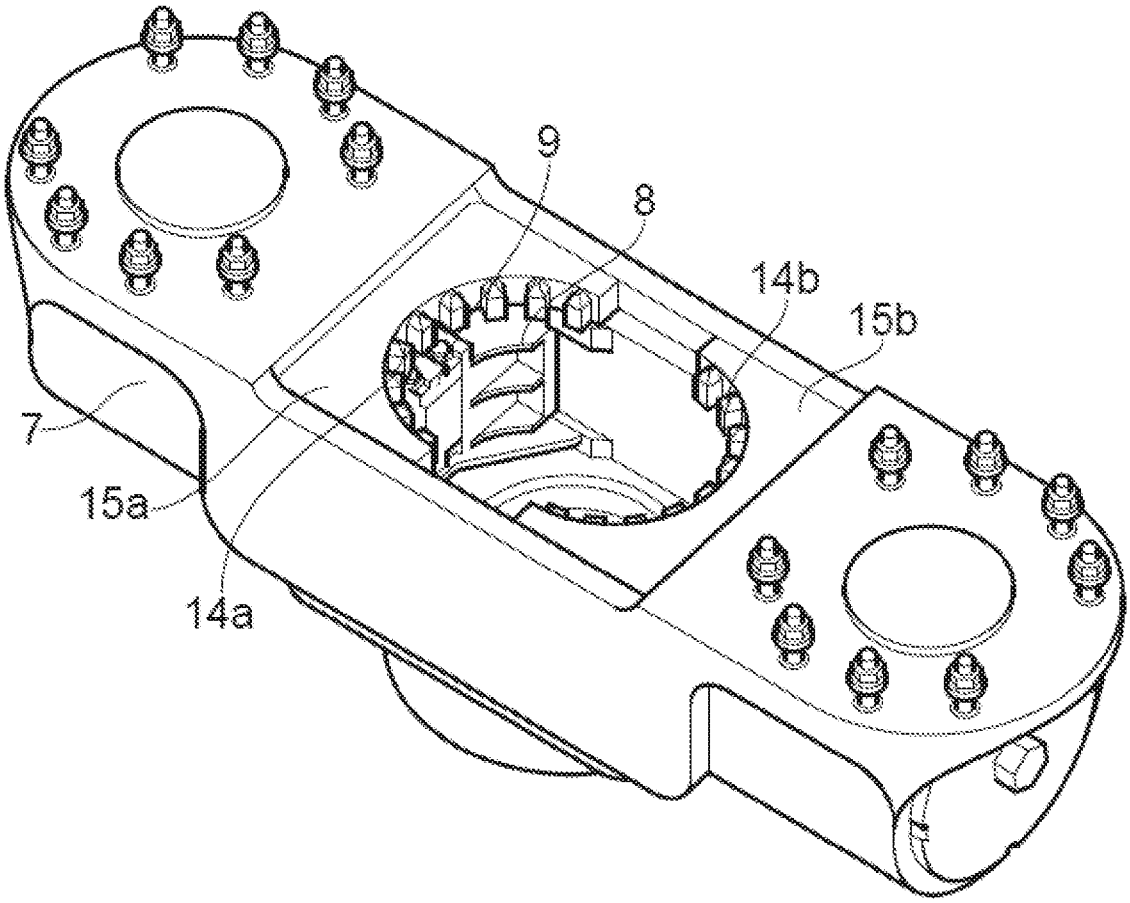
FIG. 2 illustrates a back-up wrench.

The BUW 7 has a central passage through its body and on each side of the passage a jaw 8 with a die 9 (see FIG. 2). Hydraulic cylinders (not shown in the drawings) are provided inside the BUW 7 to drive the jaws 8 towards a drill pipe (not shown in the drawings). When connecting or disconnecting a section of drill pipe to the top drive 100, the jaws 8 in the BUW 7 will clamp the drill pipe, whereby the threaded connection between the saver sub 12 and the drill pipe can be made up or broken out by applying the required torque with the drilling motors 2*a* and 2*b*. The torque for holding the drill pipe will thus be taken up by the telescopic torque arrestor frame 5 and transmitted to the housing 1 so that a high-torque connection can be made.

The BUW 7 is further provided with toothed surfaces 14*a* and 14*b* (see FIG. 2). The toothed surfaces 14*a* and 14*b* are provided on movable plates 15*a* and 15*b*, which are slidable within the body of the BUW 7. The toothed surfaces 14*a* and 14*b* may, however, also be provided directly in the body of the BUW 7. The toothed surfaces comprise a plurality of teeth projecting inwardly in relation to a longitudinal axis 16 (see FIG. 1) of the top drive 100. The teeth may alternatively project upwards towards the housing 1 as seen from the BUW 7.

Figure 3:
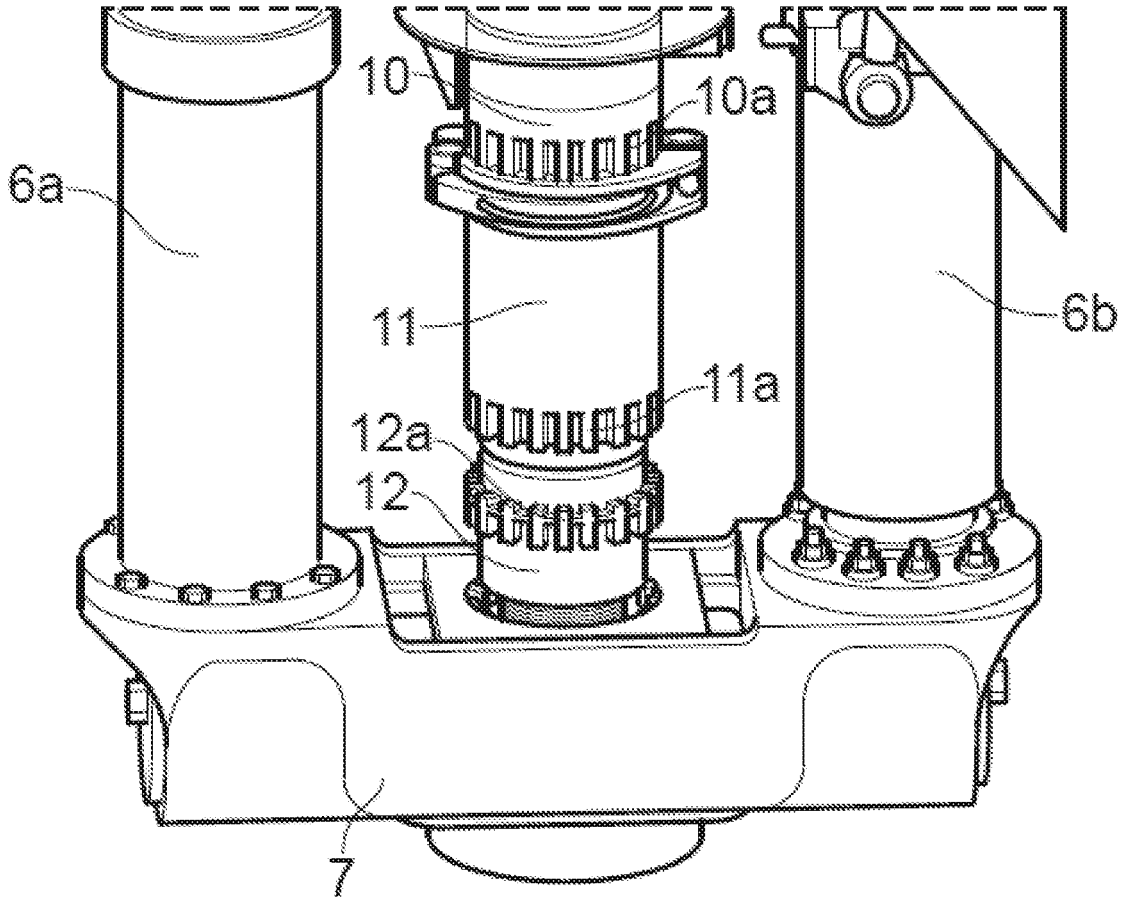
FIG. 3 illustrates the back-up wrench of FIG. 2 in a first operating position.
Figure 4:
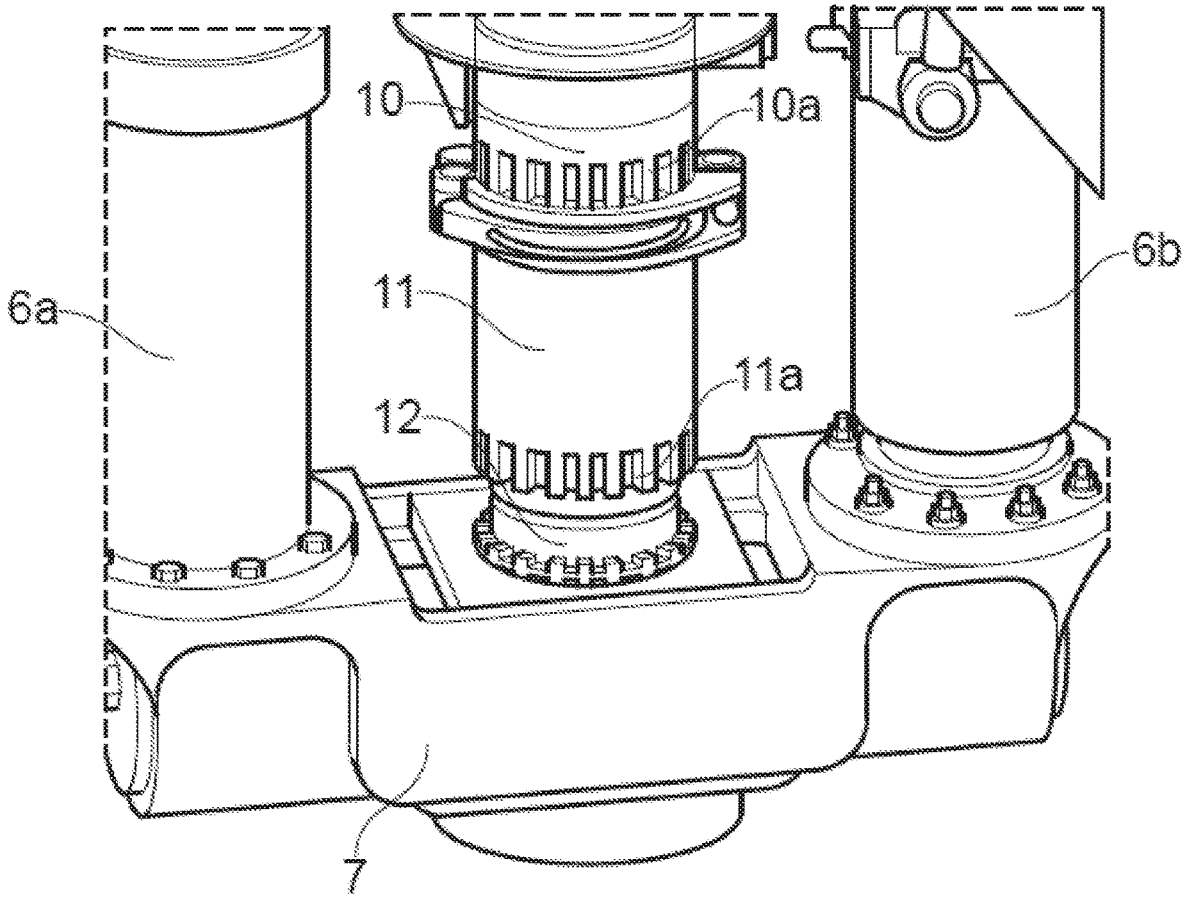
FIG. 4 illustrates the back-up wrench of FIG. 2 in a second operating position.

The movable plates 15*a* and 15*b* have a retracted position in which the movable plates 15*a* and 15*b* are spaced from the central passage, as can be seen in FIG. 2, and an advanced position in which the movable plates 15*a* and 15*b* are positioned towards the central passage, as can be seen in FIGS. 3 and 4.

The toothed surfaces 14*a* and 14*b* are configured to cooperate with a corresponding grooved surface on a threaded element, such as a kelly valve, an IBOP, or a saver sub. By bringing the toothed surfaces into engagement with a grooved surface on the threaded element, the toothed surface may take up and transfer any torque applied to the threaded element by the drilling motors 2*a* and 2*b* to the telescopic torque arrestor frame 5.

FIGS. 3 and 4 show a process of breaking out internal subs according to the present invention. As in FIG. 1, an upper IBOP 10, a lower IBOP 11, and a saver sub 12 (hereinafter likewise referred to as "subs") are suspended by the top drive. In FIG. 3, the movable plates 15*a* and 15*b* have been brought to the advanced position, i.e., brought together horizontally towards the central passage. The upper IBOP 10, lower IBOP 11 and saver sub 12 are all provided with respective grooves 10*a*, 11*a* and 12*a* on their outer circumference.

In FIG. 4, the BUW 7 has been raised by the first cylinder 6*a* and the second cylinder 6*b* to bring the toothed surfaces 14*a* and 14*b* into engagement with the grooves 12*a* of the saver sub. This forms a rotational lock so that the saver sub 12 can now be broken out, i.e., its threaded connection to the lower IBOP 11 can be released by applying torque with the drilling motors 2*a* and 2*b*. The same procedure can be used to break out the other subs, either individually, or the whole IBOP stack.

In the shown embodiment of the present invention, there is therefore no need to clamp the subs with the jaw 8 and die 9 for breaking out or making up the IBOP stack. This reduces the risk of damage to the subs and allows higher torques to be applied in the threaded connections between the individual subs and with the drive shaft 4.

In the shown embodiment of the present invention, the grooved surface on the upper IBOP 10 and the lower IBOP 11 are provided in a lower part of those subs. This provides the advantage that the BUW 7 only needs to be raised sufficiently high to reach the grooved surfaces and not, for example, to the midpoint or upper part of the IBOP 10 or IBOP 11. This allows for a more compact design, for example, a reduced total height, of the torque arrestor frame.

Figure 5:
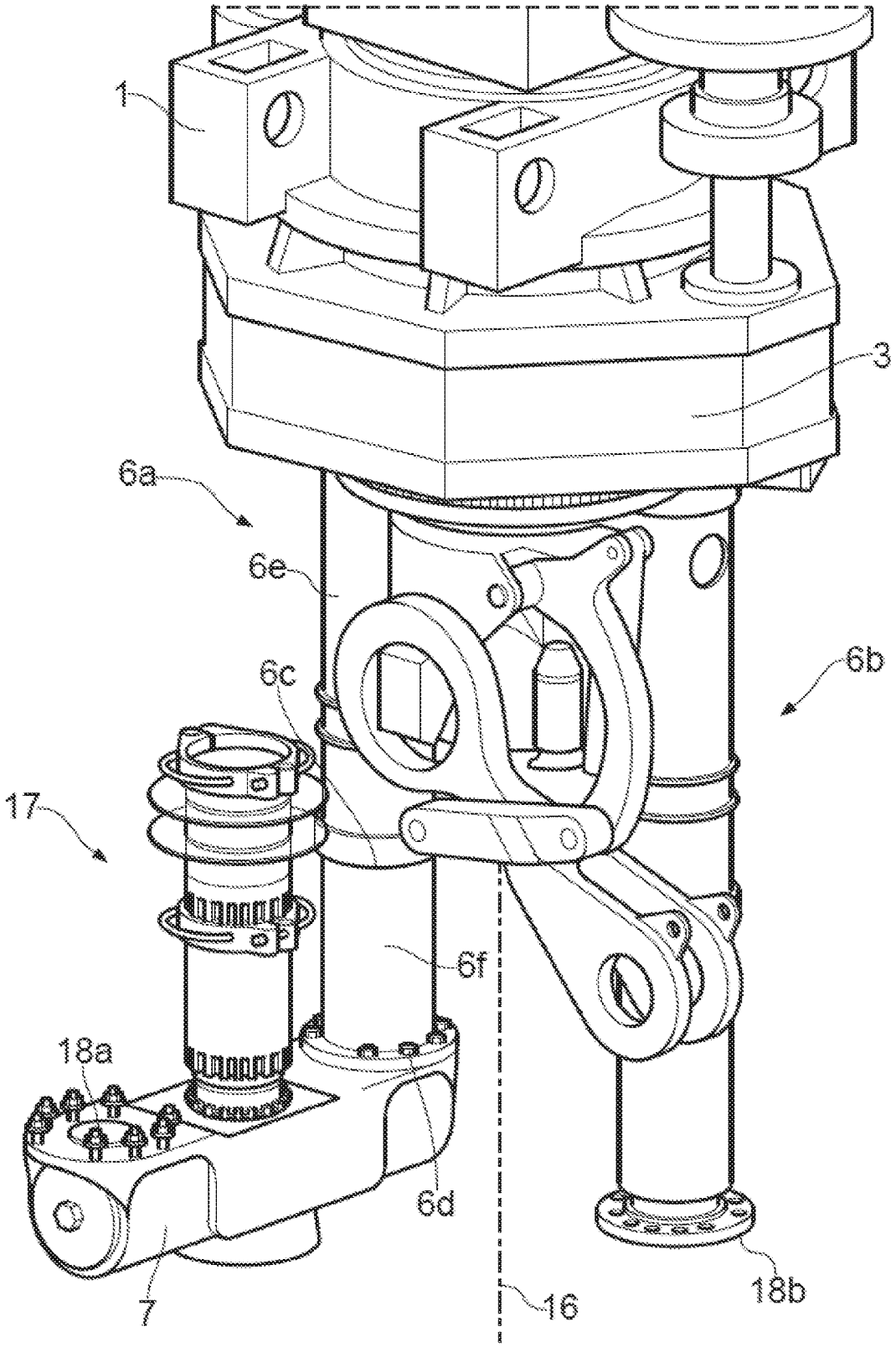
FIG. 5 illustrates the back-up wrench of FIG. 2 in a third operating position.

FIG. 5 shows a top drive according to a further embodiment of the present invention. As can be seen from FIG. 5, the BUW 7 is suspended from a top drive housing 1 by a first suspension element 6*b* and a second suspension element 6*a*. The first and second suspension elements 6*a* and 6*b* are telescopic cylinders. They may, however, also be other elements suitable for suspending the BUW 7.

A releasable coupling having a first part 18*a* and a second part 18*b* allows the first suspension element 6*b* to be selectively connected or disconnected from the BUW 7. The coupling may be bolts and nuts, as illustrated in FIG. 5, or any other suitable type of mechanical coupling.

The top drive further comprises a pivotable coupling adapted to allow for a pivoting of the entire BUW 7 substantially in the horizontal plane when the BUW 7 is disconnected from the first suspension element 6*b*. The pivotable coupling may be provided in a connection 6*c* between a first part 6*e* and a second part 6*f* of the second suspension element 6*a*. As shown in FIG. 5, the second suspension element 6*a* can, for example, be a telescopic cylinder wherein the first part 6*e* is a cylinder housing and the second part 6*f* is a rod. The rod can be made rotatable in relation to the housing in a manner known in the art. The pivotable coupling may alternatively be provided in a connection 6*d* between the BUW 7 and the second suspension element 6*a*. This may be achieved, for example, via a bearing arrangement in the BUW 7.

The BUW 7 may thus be pivoted, or swung out, in relation to its regular operating position. Easier access to an IBOP stack 17 can be achieved in the swung out position. This is achieved by disconnecting the IBOP stack 17 from the main drive shaft 4 (see FIG. 1), clamping the IBOP stack 17 with a jaw 8 or with movable plates 15*a* and 15*b* (see FIG. 2), and swinging out the BUW 7. The IBOP stack 17 is thus supported by the BUW 7 and spaced from its regular operating position in line with a central longitudinal axis 16 of the top drive. After swinging out the BUW 7, the IBOP stack 17 can more easily be accessed and removed, for example, with a lifting sling, and a new sub or IBOP stack can be inserted into the BUW 7.

In the embodiment shown in FIG. 5, the entire BUW 7 is swung out, thus providing support for the IBOP stack 17 at all times until substantially the full weight of the IBOP stack 17 has been taken by, for example, a crane via a lifting sling. Swinging out the IBOP stack 17 may permit a crane or the like to lift the IBOP stack 17 vertically out of the BUW 7. This eases handling and improves safety.

The terms toothed and grooved as used herein shall be taken to mean any type of teeth, grooves, serrations, splines or the like, suitable for creating an interlocking engagement between two elements in which the elements are locked for relative motion in at least one direction or direction of rotation.

The present invention is not limited to embodiments described herein; reference should be had to the appended claims.

What is claimed is:

1. A top drive for a drilling rig, the top drive comprising:
a top drive housing comprising a central longitudinal axis;
a threaded element used in a drilling operation, the threaded element comprising a grooved surface; and
a back-up wrench comprising at least one plate which comprises a toothed surface, the at least one plate being configured to be movable along an axis which is different from the central longitudinal axis of the top drive, the at least one plate comprising the toothed surface being provided within the back-up wrench so as to be slidable within and with respect to the back-up wrench, the toothed surface being configured to engage with the grooved surface of the threaded element,
wherein,
the back-up wrench is suspended from the top drive housing, and
the back-up wrench is configured to be movable in relation to the top drive housing so as to selectively engage the threaded element.

2. The top drive as recited in claim 1, wherein the threaded element is a saver sub, a kelly valve, or an inside blow out preventer.

3. The top drive as recited in claim 1, wherein,
the top drive further comprises a main drive shaft, and
the threaded element is suspended from the main drive shaft.

4. The top drive as recited in claim 1, wherein the grooved surface is arranged in a lower part of the threaded element.

5. The top drive as recited in claim 1, wherein,
the back-up wrench comprises two plates,
the toothed surface is provided on the two plates within the back-up wrench, and
the two plates are configured to be individually movable along the axis which is different from the central longitudinal axis of the top drive.

6. The top drive as recited in claim 1, wherein the toothed surface comprises a plurality of teeth which are arranged to project inwardly in relation to the central longitudinal axis of the top drive.

7. A top drive for a drilling rig, the top drive having a central longitudinal axis and comprising:
a top drive housing;
a pivotable coupling;
a first suspension element;
a second suspension element;
a back-up wrench which is suspended from the top drive housing via the first suspension element, the second suspension element, and the pivotable coupling; and
a releasable coupling arranged between the first suspension element and the back-up wrench and via which the back-up wrench is fully disconnectable from the first suspension element,
wherein,
the pivotable coupling is configured to allow a pivoting of the entire back-up wrench as one unit at the same time so that a central passage of the back-up wrench remains intact during the pivoting, the pivoting occurring in a plane which is substantially perpendicular to the central longitudinal axis when the back-up wrench is disconnected from the first suspension element.

8. The top drive as recited in claim 7, wherein the pivotable coupling is arranged in the second suspension element.

9. The top drive as recited in claim 7, further comprising:
a connection point arranged between the second suspension element and the back-up wrench,
wherein, the pivotable coupling is arranged at the connection point.

10. The top drive as recited in claim 7, wherein at least one of the first suspension element and the second suspension element are provided as telescopic cylinders.

11. The top drive as recited in claim 7, wherein the back-up wrench is pivotable around an axis which is parallel to the central longitudinal axis.

12. The top drive as recited in claim 11, wherein the back-up wrench is pivotable around a central axis of the second suspension element.

13. The top drive as recited in claim 7, further comprising:
a stack comprising at least one inside blow out preventer; and
a main drive shaft,
wherein,
the top drive comprises,
(i) a first operational configuration in which the stack is carried by the main drive shaft, and
(ii) a second operational configuration in which the stack is carried by the back-up wrench.

14. The top drive as recited in claim 13, wherein the stack is spaced from the central longitudinal axis of the top drive in the second operational configuration.

15. A top drive for a drilling rig, the top drive having a central longitudinal axis and comprising:
a top drive housing;
a pivotable coupling;
a first suspension element;
a second suspension element;
a back-up wrench which is suspended from the top drive housing via the first suspension element, the second suspension element, and the pivotable coupling; and
a releasable coupling arranged between the first suspension element and the back-up wrench and via which the back-up wrench is fully disconnectable from the first suspension element,
wherein,
the pivotable coupling is only configured to allow a pivoting of the entire back-up wrench as one unit in a plane which is substantially perpendicular to the central longitudinal axis when the back-up wrench is disconnected from the first suspension element, and a central passage of the back-up wrench remains intact during the pivoting.

* * * * *